US009815533B2

(12) United States Patent
Wood

(10) Patent No.: US 9,815,533 B2
(45) Date of Patent: Nov. 14, 2017

(54) BOAT BUOYANCY AID

(71) Applicant: Dru Wood, Salonika Beach (AU)

(72) Inventor: Dru Wood, Salonika Beach (AU)

( * ) Notice: Subject to any disclaimer, the term of this patent is extended or adjusted under 35 U.S.C. 154(b) by 0 days.

(21) Appl. No.: 15/011,612

(22) Filed: Jan. 31, 2016

(65) Prior Publication Data

US 2016/0214691 A1 Jul. 28, 2016

Related U.S. Application Data

(63) Continuation-in-part of application No. PCT/AU2014/050164, filed on Jul. 31, 2014.

(30) Foreign Application Priority Data

Jul. 31, 2013 (AU) ..... 2013902851

(51) Int. Cl.
*B63B 7/00* (2006.01)
*B63C 7/00* (2006.01)
*B63B 17/02* (2006.01)

(52) U.S. Cl.
CPC ..... *B63C 7/003* (2013.01); *B63B 17/02* (2013.01)

(58) Field of Classification Search
CPC ..... B63B 17/02; B63C 7/003
See application file for complete search history.

(56) References Cited

U.S. PATENT DOCUMENTS 4,683,900 A * 8/1987 Carmichael ..... B63B 17/02 114/361
5,603,646 A * 2/1997 Tobias ..... A41D 13/0125 441/106
6,280,271 B1 * 8/2001 Peterson ..... B63B 17/02 441/129
2002/0067031 A1 * 6/2002 Busgen ..... B60R 21/18 280/733
2010/0083891 A1 * 4/2010 Russikoff ..... B63B 17/02 114/361
2012/0255196 A1 * 10/2012 Gishifu ..... A43B 13/203 36/29

* cited by examiner

*Primary Examiner* — Stephen Avila
(74) *Attorney, Agent, or Firm* — The Culbertson Group, P.C.

(57) ABSTRACT

A dinghy has a hull with gunwales supporting a Bimini top. The Bimini top includes a primary bow supporting secondary and intermediate bows. A UV stabilized polyester Bimini canvas is supported on the bows by fore, aft, and intermediate sleeve portions. The underside of the Bimini canvas supports port and starboard buoyancy aid assemblies each comprising a bladder which is inflatable by an inflation mechanism and $CO_2$ cartridge, and is maintained in its collapsed state by tape loop assemblies adjustable by hook-pile self-fastenings which are frangible on inflation. A protective cover is stitched to the Bimini canvas and is provided with hook-pile fastening means frangible on inflation. A toggle handle pulls a lanyard which passes into the primary bow to operate the mechanism to inflate the bladder.

20 Claims, 8 Drawing Sheets

BOAT BUOYANCY AID

CROSS-REFERENCE TO RELATED APPLICATION

Applicant claims the benefit of PCT International Patent Application No. PCT/AU2014/050164 filed Jul. 31, 2014, and entitled "Boat Buoyancy Aid." The entire content of this international patent application is incorporated herein by this reference.

FIELD OF THE INVENTION

This invention relates to a boat buoyancy aid. This invention has particular application to a boat buoyancy aid for use in conjunction with a Bimini or Targa top to assist in righting a capsized open boat, and for illustrative purposes the invention will be described with reference to this application. However it is envisaged that this invention may find use in other applications such as providing deployable reserve buoyancy for boats generally.

BACKGROUND OF THE INVENTION

Small motor boats and dinghies are prone to capsize. In most cases, the swamped or capsized vessel has a degree of reserve buoyancy, meaning that the vessel does not sink per se. In the case of a conventional forward or tiller-steered open boat, these are generally of bond wood or cold moulded or strip planked wood, aluminium, fibreglass or other fibre reinforced resin material, or rotary moulded plastic (poly).

Boats may be inherently buoyant, such as some timber boats, foam or balsa cored resin boats or double skinned poly boats. Others may be provided with constructed buoyancy, such as watertight or foam filled chambers or voids. For example, it is commonplace to provide aluminium dinghies with thwarts of inverted, flat-bottomed U-shape, riveted or welded to the hull and/or transom inside the boat and having blocks of buoyancy foam bonded into the hollow undersides.

Self-righting devices for vessels comprising a gas-inflatable bladder arrangement are known. In general these require a purpose made frame or platform elevated above the vessel hull at the stern and having bolted thereto a relatively large inflatable chamber. For example a self-righting system may include a heavy-duty coated fabric chamber including sewn-in reinforced tabs having multiple eyelets or trapped-head threaded studs to permit bolting and/or lacing to the frame or platform. The volume of the chamber calculated by taking into account the weight, beam and load of the boat. The inflatable chamber is attached to the top of the frame at the stern of the boat and is connected to an external $CO_2$ inflator bottle by hose and trigger assembly. In a capsize, the manually operated $CO_2$ inflator inflates the chamber to self-right a suitable vessel, typically within half a minute.

Protection from the sun for occupants of a small vessel (and rain when not under way) is usually by way of a Bimini top. These structures comprise two or more generally stainless steel (or occasionally aluminium or composite) tubular bows each formed with port and starboard risers supporting an athwart overhead bow portion. One of the bows may be pivoted to opposed gunwale locations to be rotatable fore-and-aft. One or more other of the bows may be pivoted to opposed riser points on the first bow to also be rotatable fore-and-aft. The net effect is of an overhead framework that may be folded down to the gunwales. The bow portions are located in respective pockets of a poly canvas or vinyl Bimini cover. The assembly of the bows is strut, strap or cable stayed, with tension in the struts, straps or stays functioning to keep the Bimini cover taut between the bow portions.

For the most part such vessels are powered by outboard motors. However, some are inboard-engine powered, such as Hamilton-style jet boats and drive leg-driven boats.

To a greater or lesser extent, a small boat of the type described will, when swamped, reach a stable attitude floating in the water. Depending on the relative location of the centre of buoyant lift relative to the centre of gravity, the attitude may be upright or inverted, or bow up and bow down. The most common attitude for an outboard-powered dinghy having two or more buoyant thwarts is inverted and bow-high. In an accidental swamping and capsize, the buoyant vessel forms a poor support for occupants awaiting rescue, both from the point of view of exposure to the elements and predators and from the point of view to access to safety gear in the vessel. Clinging to an upturned hull in rough seas can prove extremely challenging. As fatigue and exposure take their toll the passengers find it more and more difficult to cling to a wet, slippery and very unstable object. Food, water, clothing, and all safety gear will be located inside the upturned vessel out of reach and possibly lost to the occupants.

It has been widely reported that approximately 85% of boating fatalities in boats under 6 m are the result of swamping or capsize. Capsize is often unexpected and happens in a few seconds. There is a likelihood of being unable to grab everything that is needed for enhancing odds of survival other than what is immediately to hand. Many persons have died within the few hours following capsize before help reached them. Men on a fishing trip are the most likely casualty.

For various reasons the aforementioned self-righting systems are unsuited to self-right a Bimini or Targa top-equipped vessel. At first instance the presence of a Bimini or Targa top effectively prevents a push pit or support frame of sufficient height to be positioned at the stern of the vessel. Secondly, if a frame or support were to vertically clear the Bimini or Targa, the excess weight set high would compromise roll stability.

SUMMARY OF THE INVENTION

In one aspect the present invention resides broadly in a boat buoyancy aid including a fabric cover member supported above respective gunwales of a boat hull, one or more inflatable buoyancy chambers formed in said fabric cover member, and an inflation gas supply selectively operable to inflate said buoyancy chambers.

The fabric cover member may be supported on a Bimini and/or Targa bar structure. For example, a folding Bimini/Targa top may provide additional stiffness in application of a righting moment over a Bimini top alone. A typical Targa bar may be pivotally supported on a pair of Targa mounts and selectively secured upright. The fabric cover member may have a rear edge supported on the Targa bar and may be foldably spread and supported by at least a forward bow pivoted to the Targa bar. The Bimini upper shape may be formed by one or more intermediate bows pivoted to the forward bow.

The one or more inflatable buoyancy chambers may include an open celled, self-inflating foam core in a compressed state, and wherein the inflation gas supply may comprise self-inflation valves selectively operable to open the interior of a respective buoyancy chamber to atmosphere to expand the foam core. In this embodiment, the self-inflator valves are opened when the Bimini or folding Targa cover is being deployed or stowed, and the self-inflator valves are closed for storage or under way. Optionally, the self-inflation valves may be connected to suction to flatten the foam core for storage.

Alternatively, each buoyancy chamber may comprise an inflatable bladder enclosed by a fabric closure portion frangibly secured to the fabric cover portion and adapted to retain and protect each inflatable buoyancy chamber in its deflated state.

The inflation gas supply may comprise means selected from an explosive gas supply and a compressed gas supply, and may be selectively operable by a trigger. The trigger may be selected from one or more of mechanical, immersion or hydrostatic triggers.

The fabric cover member may be supported on and form part of a Bimini top supported on two or more tubular bows by integral bow sleeves spaced fore and aft in the fabric cover member. The tubular bows may each have a substantially central bow sleeve supporting portion bounded by respective strut portions adapted to elevate the fabric cover member above respective gunwales of a boat hull, the bows in assembly being pivoted to said gunwales to permit folding and having stays to secure the Bimini top in a deployed position.

The Bimini top may comprise a primary bow having a pair of spaced strut portions each extending from a pivot point on each gunwale and an upper portion forming the aft edge of the Bimini top, the strut portions of the primary bow supporting respective ends of pivotally mounted forward and optionally one or more intermediate bows. The fabric cover member is usually formed on UV stabilized polyester woven fabric or textile reinforced vinyl (PVC). The integral bow sleeves are usually stitched in, the fore and aftermost sleeves being formed by turning over the leading and trailing cover edges respectively. Any bow sleeves intermittent the fore and aftermost sleeves may be continuous or intermittent athwartships.

The inflatable buoyancy chambers may comprise a pair of spaced chambers each adapted to locate on the cover member at respective port and starboard sides thereof. However, it is preferred that the inflatable buoyancy chambers are located transverse the vessel adjacent the aft edge of the Bimini cover. By this means the Bimini is not impeded while folding. The centre of buoyancy is also located in a vertical plane as close as possible to the plane containing the centre of gravity of an outboard powered vessel. While the centre of gravity of the vessel out of the water is not immediately determinative of the centre of gravity of the immersed and capsized vessel, it may follow that the bias of the engine weight is best offset by appropriately locating the centre of buoyancy of the inflatable chamber.

The inflatable buoyancy chamber may comprise a single layer or multilayer bladder or the like. The buoyancy chamber may comprise a single chamber or multiple chambers. The buoyancy chamber may include woven or non-woven bladder materials. In some embodiments the bladder material may be the same or similar to the bladder materials used in inflatable personal flotation devices (PFDs). In others the bladder material may be more akin to the laminated used in the construction of inflatable boats, such as fabric-reinforced vinyl materials, HYPALON® or the like.

The bladder material may be a woven NYLON® or polyester material coated with a polyurethane or polyolefin heat bonding/gas seal layer. Lightweight material may for example comprise high tensile or standard closely woven NYLON®, having a coating such as flame-retardant or standard thermoplastic polyurethane (TPU). Other materials include silicone coated rip stop NYLON®, HD Polyester and TPU ether film.

The inflatable buoyancy chamber may be integrally formed with the cover member. For example, the inflatable chamber may comprise a body portion in the manner of an open topped collapsible container seam welded by the periphery of its open top to the cover member. Alternatively the inflatable buoyancy chamber may be installed to the Bimini top. The buoyancy chamber may be capable of direct installation on the Bimini top or may be pre-loaded into a deployment cover incorporating the fabric closure portion. For example, a deployment cover may comprise a low stretch e.g. polyester canvas cover adapted to contain a deflated bladder and be closed by the closure portion by means such as a clip-together means or hook-pile fastening, selected to be frangible to release the inflating chamber.

The inflatable buoyancy chamber may be sewn or otherwise secured to the fabric cover, with or without further lacing to one or more said bows. For example, the inflatable buoyancy chamber may be provided with a mounting portion adapted to be one or more of stitched to the cover member and laced to a bow. The aforementioned HYPALON® or NYLON® composite fabrics may be seamed with integral mounting flanges formed therein, permitting stitching to the cover member and/or prepared with eyelets, cringles or grommets for lacing.

The one or more buoyancy chambers may be inflated concurrently or independently.

However the inflation chambers are supported, the inflation gas may comprise $CO_2$ delivered from compressed-gas storage means such as a liquid-$CO_2$ cartridge or fire-extinguisher-type pressure vessel. Alternatively, the inflation gas may be compressed air, substantially inert gas such as nitrogen, or inert gas such as helium or argon, although space constraints may limit the use of gases that cannot be liquefied under low to moderate pressure. The compressed-gas storage means is preferably co-located with the inflatable chamber under the fabric closure portion.

The trigger means will be selected having regard to the choice of inflation gas and the manner of its storage. In the case of liquid-$CO_2$ cartridge means, the trigger may be selected from one or more of toggle-pull, immersion or depth-activated (hydrostatic) triggers as are known to the art of PFDs and life raft deployment. In other instances the trigger means may take the form of an automatic or manual valve.

The trigger means may be co-located with the inflation gas supply means or may be remotely operated. For example, in the case of a Bimini top, a liquid-$CO_2$ cartridge and trigger assembly may be toggle-operated at the assembly or may be cable-operated remotely. The cable may be laid internally or externally of a bow or other frame member to be led to a gunwale or elsewhere. The cable may be led to the same or an opposite gunwale to a port or starboard deployed buoyancy chamber. For example, both lanyards may be led to the starboard gunwale since this is the gunwale most likely to be free for the longest in capsize of a tiller steered, outboard-powered dinghy. The remote operating cable may be terminated by a remote pull handle or toggle. The remote pull handle or toggle may be protected from accidental deployment such as a cover or hook-pile fastening-closed pouch.

The trigger may be hydrostatic, that is, activated by submergence of the trigger to an activation depth corresponding to an expected depth of submergence on capsize of the vessel. The hydrostatic trigger may be associated or co-located with the compressed-gas storage means under the fabric closure portion. This configuration does not require manual activation, protects the deployment mechanism inside the stowed system and is not as likely to accidentally deploy as water activated systems.

In use, on capsize the buoyancy aid apparatus is deployed, changing the relative location of the centre of buoyancy of the vessel relative to the centre of gravity. This has the intended effect of rolling or maintaining the capsized vessel at least on its beam ends to permit access to the inside of the hull and potentially enabling the vessel to be rolled to an upright position.

BRIEF DESCRIPTION OF THE DRAWINGS

The invention will be described with reference to the following non-limiting embodiment of the invention as illustrated in the drawings and wherein.

DESCRIPTION OF PREFERRED EMBODIMENTS

Figure 1:
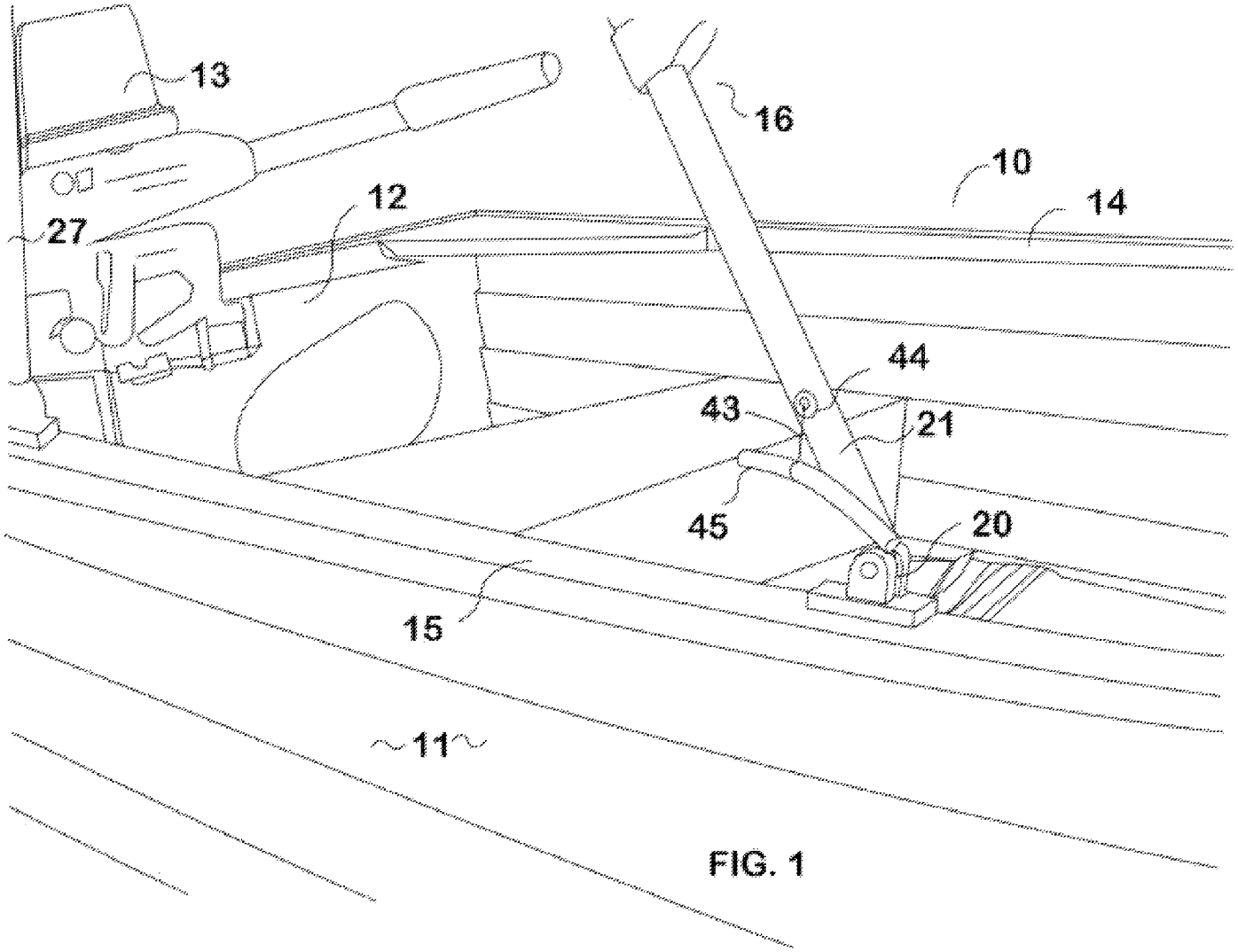
FIG. 1 is a perspective view of the relevant portions of a dinghy suitable for use with one embodiment of the present invention.

In the figures there is provided a dinghy 10 having an aluminium hull 11 bounded by a transom 12 bearing an outboard motor 13 and port 14 and starboard 15 gunwales. The gunwales 14, 15 support a Bimini top assembly 16 via pivot mounts 20 supporting the respective ends of a primary bow 21. The primary bow 21 is the aft bow of the Bimini top 16 and pivotally supports a secondary bow 22, and an intermediate bow 23. The bows 21, 22 and 23 are assembled to a UV stabilized polyester Bimini canvas 24 by threading pre-assembly into fore 25, aft 26 and intermediate 28 sleeve portions. In the example illustrated the Bimini top assembly 16 is tensioned aft by tension struts 27 and tensioned forward by tensioning straps 30, which are selectively detached from the gunwales 14, 15 to allow the Bimini top assembly 16 to fold.

Figure 2:
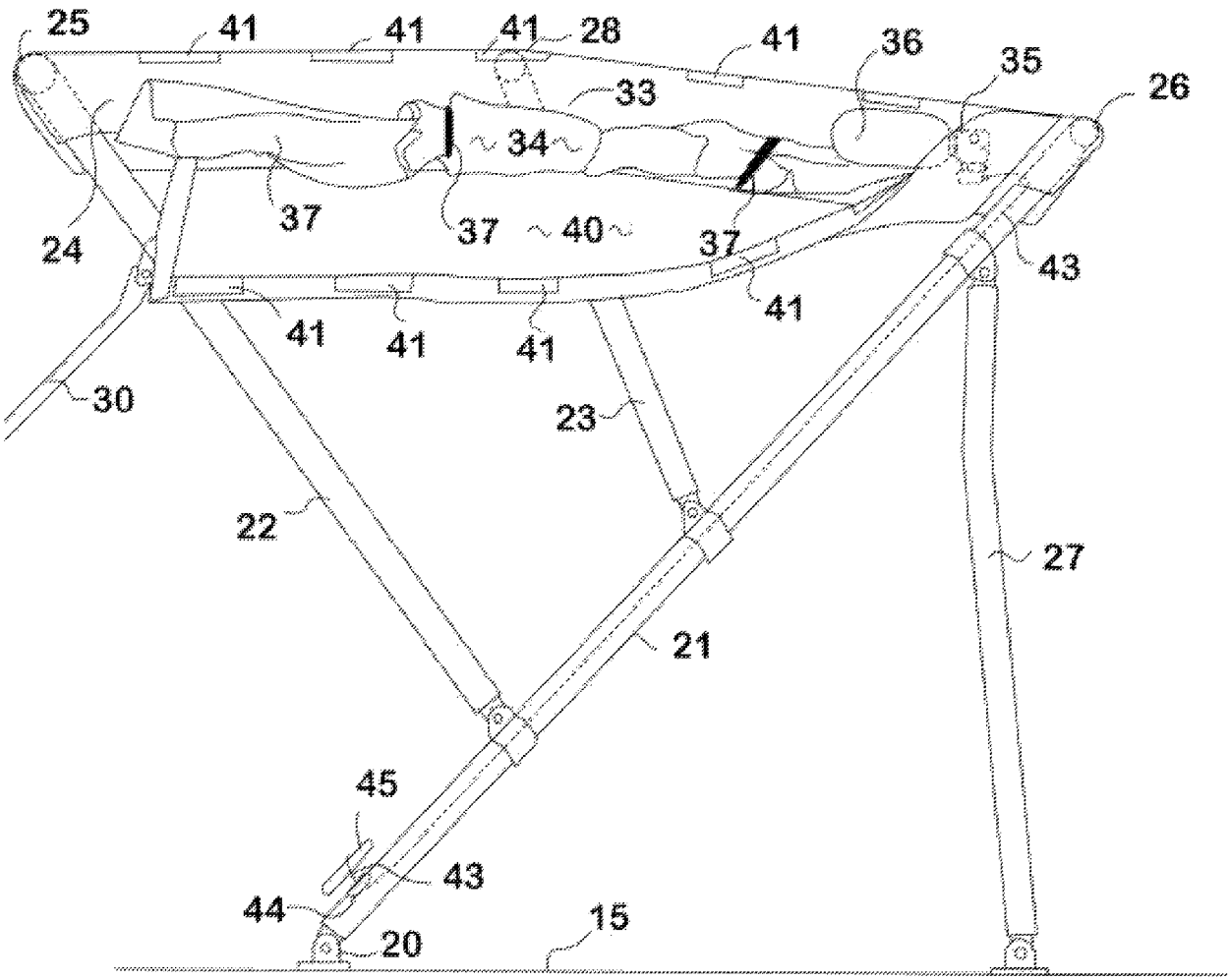
FIG. 2 is an exposed perspective view of a boat buoyancy aid when used in the dinghy of FIG. 1.
Figure 3:
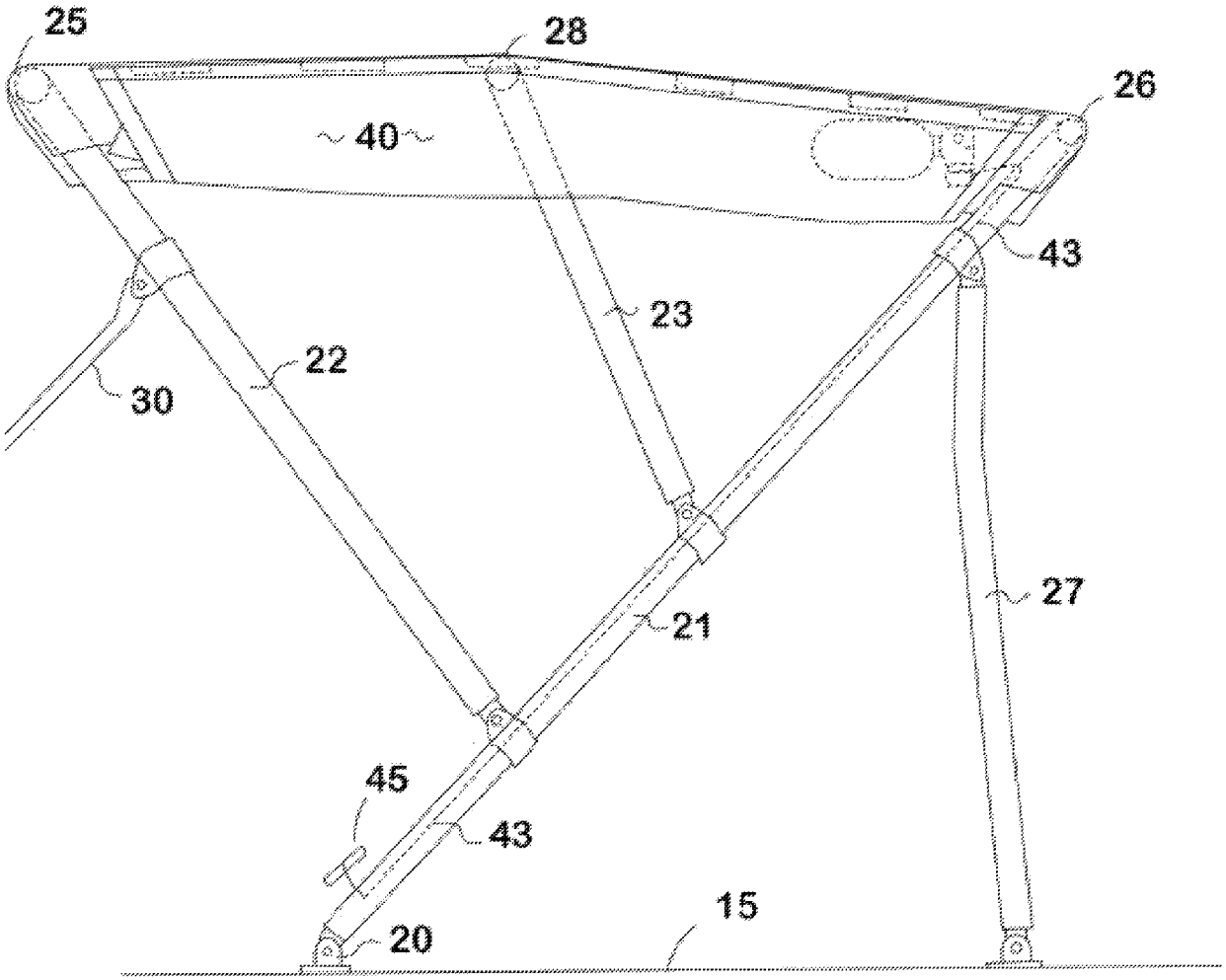
FIG. 3 is a covered-up perspective view of the boat buoyancy aid of FIG. 2.

In the first embodiment of FIGS. 1 to 3, the Bimini top assembly 16 has port and starboard lateral turns at each of which, on the underside of the Bimini canvas 24, is located a buoyancy aid assembly 33. The buoyancy aid assembly 33 comprises an elongate bladder 34 of heat sealed woven NYLON®/TPU laminate and secured to the primary bow 21 by a HALKEY-ROBERTS® inflation mechanism 35 adapted to inflate the bladder 34 from $CO_2$ cartridge 36. The bladder is further maintained in its collapsed state by tape assemblies 37, and is secured to the bows 21, 22 and 23 by ties (not shown). The tape assemblies 37 are adjustable by hook-pile fastenings between a small size retaining the collapsed bladder 34 and a large size retaining the inflated bladder 34.

A protective cover 40 of polyester canvas is stitched to the Bimini canvas 24 side edges and is provided with hook-pile fastening means 41 adapted to rip open as the bladder 34 inflates.

The HALKEY-ROBERTS® inflation mechanism 35 has a threaded aperture adapted to receive and sealingly support the $CO_2$ cartridge 36 whereby operation of a crank (not shown) drives a hollow pin (not shown) through the metal seal of the cartridge 36 to inflate the bladder 34. The crank is operated by a lanyard 43 which passes through a plastic fairlead into the primary bow 21.

In the illustrated embodiment, the lanyards 43 of the port and starboard buoyancy aid assemblies 33 are both led out of the primary bow 21 through a plastic fairlead 44 adjacent the starboard gunwale 15, and are terminated with respective toggle handles 45. The toggle handles are protected against accidental deployment by, for example, a fabric cover (not shown).

Figure 4:
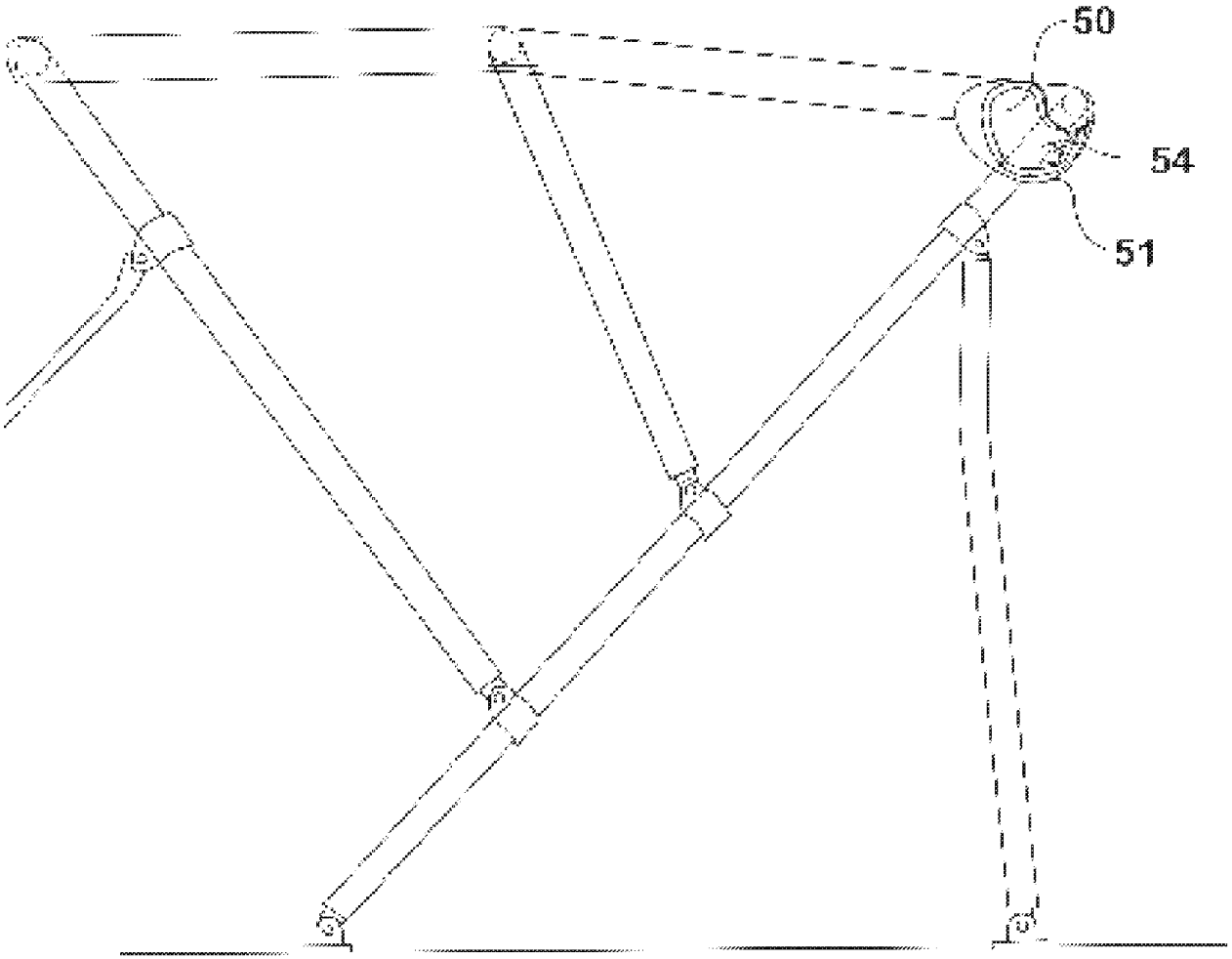
FIG. 4 is a covered-up, partially sectioned side view of a second embodiment of the present invention.
Figure 5:
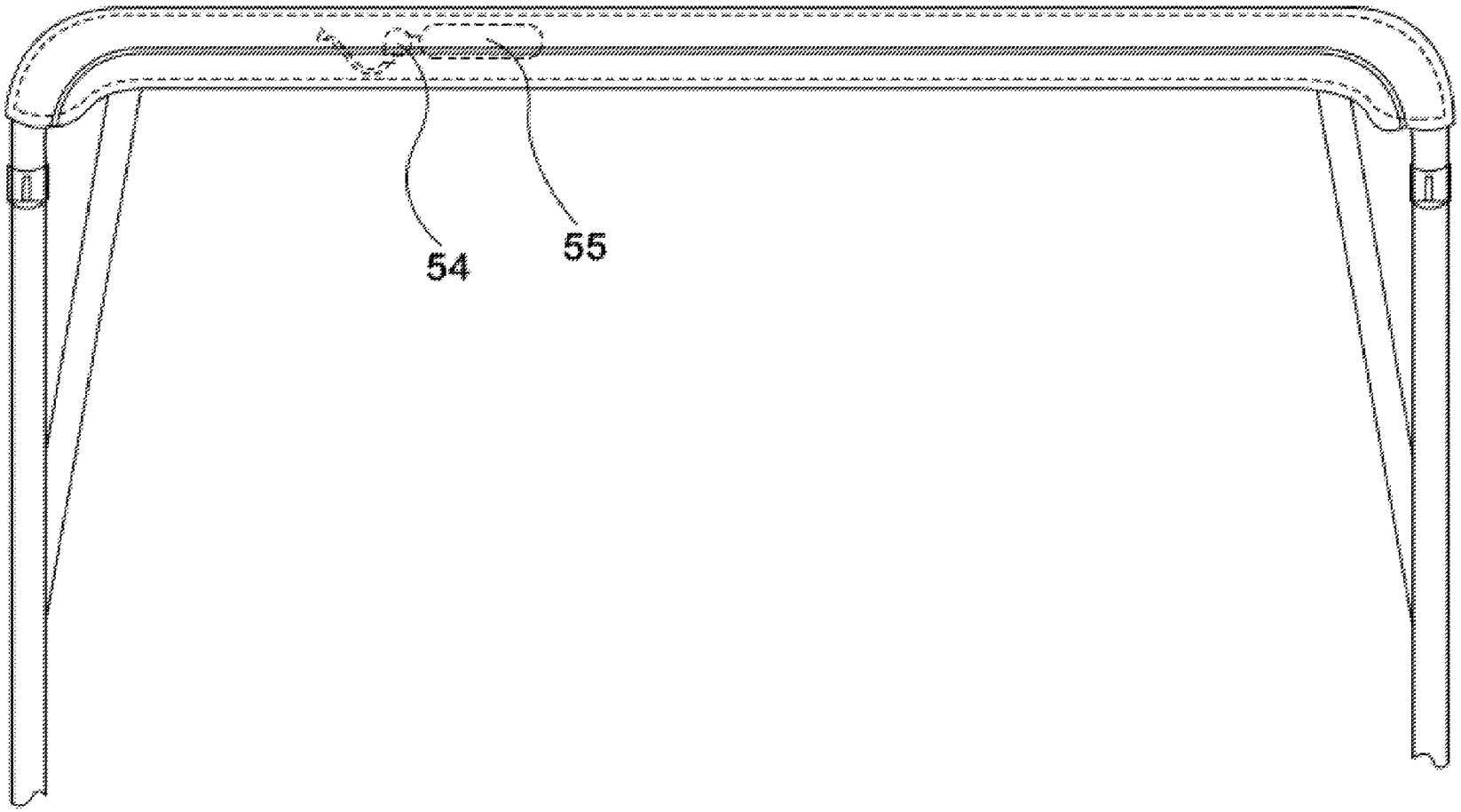
FIG. 5 is a rear closed view of the apparatus of FIG. 4.
Figure 6:
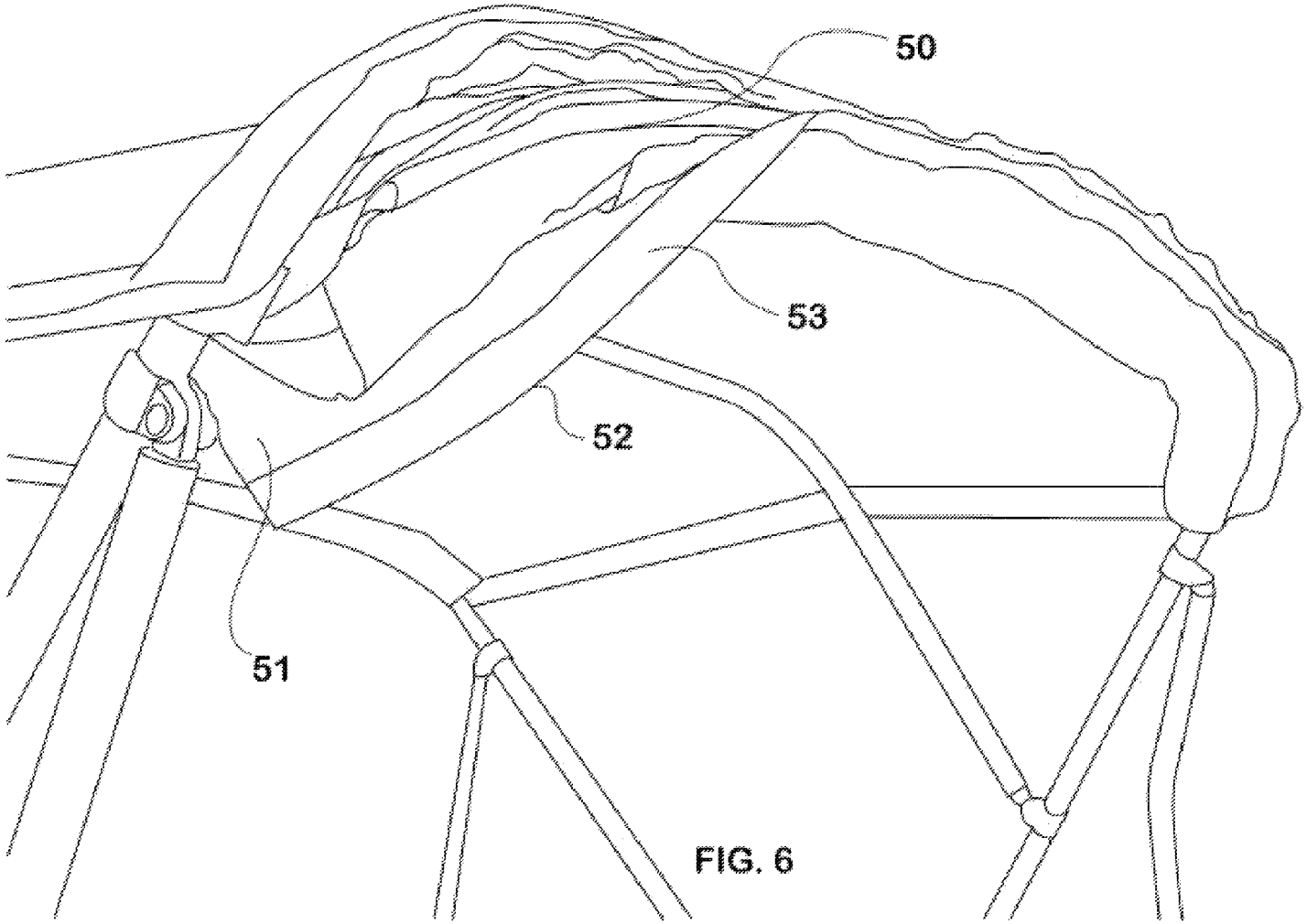
FIG. 6 is an exposed perspective view of a boat buoyancy aid according to the embodiment of FIG. 4.

In the embodiment of FIGS. 4 to 6, the structural elements of the dinghy 10 and Bimini top are numbered as per FIGS. 1 to 3.

In this embodiment, the Bimini canvas 24 has an aft sleeve portion 26 formed as before, with a stitched seam portion extending across the canvas 24 adjacent the primary bow 21. An elongate inflatable chamber 50 extends substantially across the Bimini and is formed of heat sealed woven NYLON®/TPU laminate and secured to the Bimini canvas 24 adjacent the primary bow 21 by stitching an edge portion of the inflatable chamber 50 to the stitched seam portion.

A canvas cover portion 51 is attached to the stitched seam portion concurrently with the elongate inflatable chamber 50. The canvas cover portion 51 has a free edge 52 having secured thereto a hook-pile fastening tape 53 adapted to engage a complementary tape associated with the trailing edge 54 of the Bimini canvas 24. The canvas cover portion 51 secures over the deflated elongate inflatable chamber 50 in normal operation of the vessel and the free edge 52 is released by the inflating inflatable chamber 50 in emergency use.

A hydrostatic firing assembly 54 is banjo-bolted to the inflatable chamber 50 to create an operable fluid path from a $CO_2$ cartridge 55 to the chamber 50. When the hydrostatic firing assembly 54 is lowered more than about 10 cm into water, a hydrostatic valve opens and lets water meet a water sensitive element that in turn releases a stainless steel coil spring. The spring then drives a needle into the end of the $CO_2$ cartridge 55, which is now punctured so that the gas fills the inflatable chamber 50. Total buoyancy may be reached within 5 to 30 seconds.

Apparatus in accordance with the foregoing embodiments are an integral part of the Bimini top. It is of a compact nature with a gas cartridge incorporated within the package.

Figure 7:
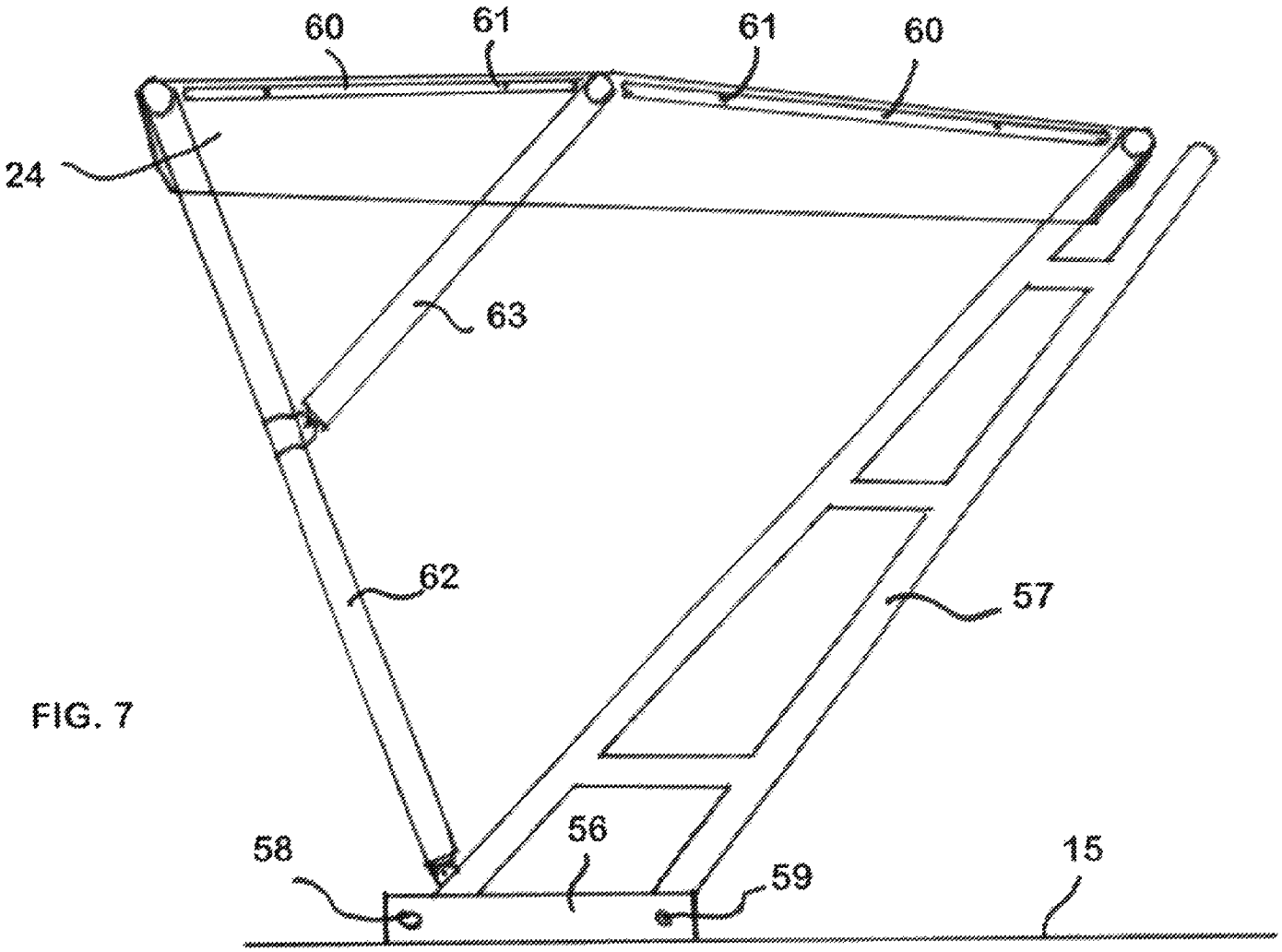
FIG. 7 is a side view of an alternative, self-inflating embodiment of the present invention, operatively deflated.
Figure 8:
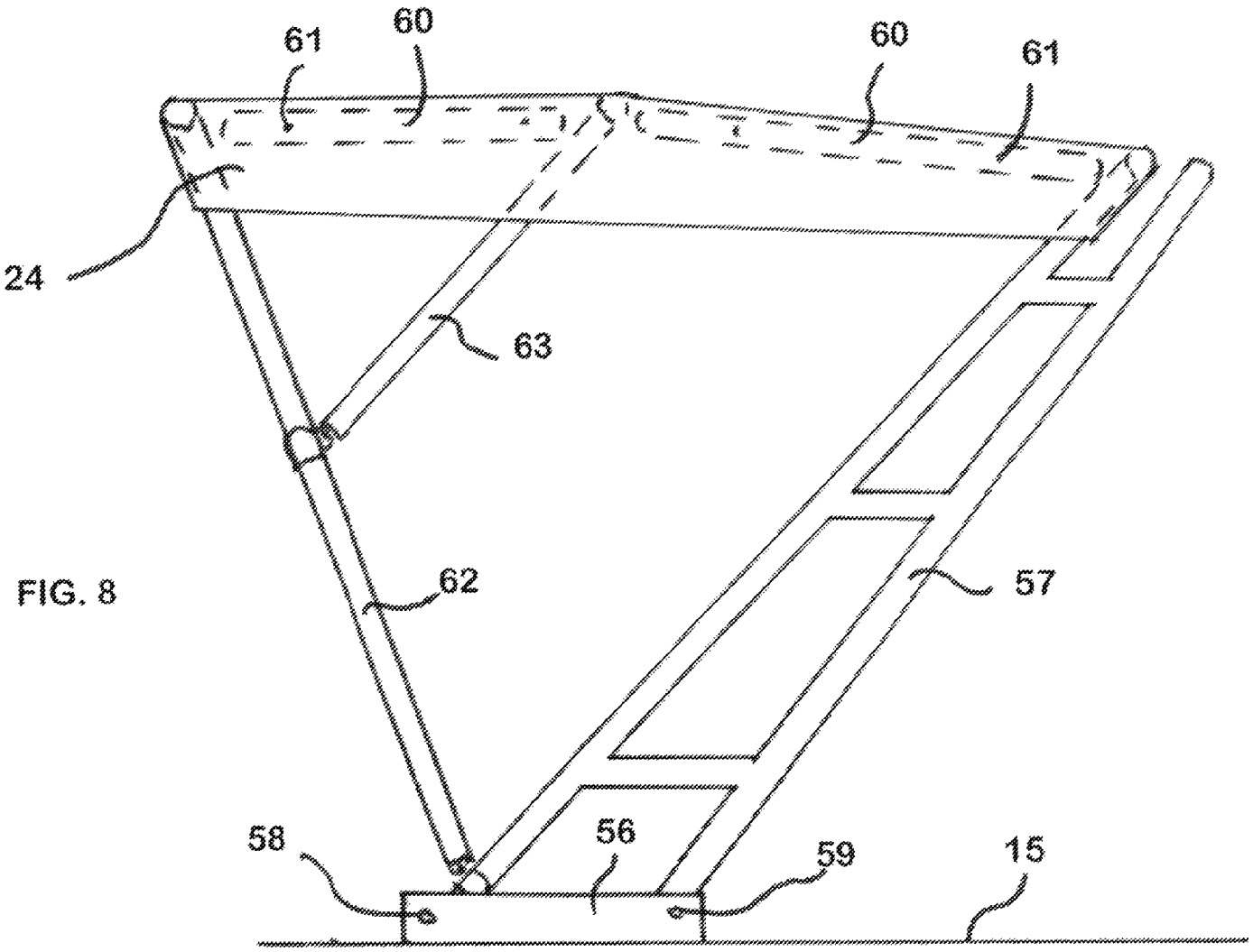
FIG. 8 is a side view of the self-inflating embodiment of FIG. 7, operatively inflated.

In the embodiment of FIGS. 7 and 8, a folding Bimini/Targa top provides additional stiffness in application of a righting moment and consists of pair of Targa mounts 56 pivotally supporting a Targa bar 57 at pivot 58. The Targa bar 57 is secured upright by clevis pins 59. A canvas cover member 24 (shown in transparency for clarity) includes a pair of transverse, integral inflation chambers 60 each including an open celled, self-inflating foam core in a compressed state. The inflation gas supply comprises screw-capped, self-inflation valves 61 selectively operable to open the interior of a respective buoyancy chamber 60 to atmosphere to expand the foam core. The cover member 24 is foldably spread and supported by a forward bow 62 pivoted to the Targa bar 57 and an intermediate bow 63 pivoted to the forward bow 62.

In this embodiment, the self-inflator valves 61 are opened when the Bimini or folding Targa cover is being deployed or stowed, and the self-inflator valves 61 are closed for storage or under way. Optionally, the self-inflation valves 61 may be connected to suction to flatten the foam core for storage.

It will of course be realised that while the above has been given by way of illustrative example of this invention, all such and other modifications and variations thereto as would be apparent to persons skilled in the art are deemed to fall within the broad scope and ambit of this invention as is set forth in the claims appended hereto.

The invention claimed is:

1. A boat buoyancy aid including a fabric cover member supported on a Bimini and/or Targa bar structure above respective gunwales of a boat hull, one or more inflatable buoyancy chambers formed in said fabric cover member, and an inflation gas supply selectively operable to inflate said buoyancy chambers, wherein said one or more inflatable buoyancy chambers include an open celled, self-inflating foam core in a compressed state, and wherein said inflation gas supply comprises self-inflation valves selectively operable to open the interior of a respective said buoyancy chamber to atmosphere to expand said foam core.

2. The boat buoyancy aid according to claim 1, wherein said fabric cover member is supported on a folding Bimini/Targa top including a Targa bar pivotally supported on a pair of Targa mounts and selectively secured upright, the fabric cover member having a rear edge supported on the Targa bar and being foldably spread and supported by at least a forward bow pivoted to the Targa bar.

3. A boat buoyancy aid including a fabric cover member supported on a Bimini and/or Targa bar structure above respective gunwales of a boat hull, one or more inflatable buoyancy chambers formed in said fabric cover member, and an inflation gas supply selectively operable to inflate said buoyancy chambers, wherein said fabric cover member is supported on and forms part of a Bimini top and is supported on two or more tubular bows by integral bow sleeves spaced fore and aft in said fabric cover member, the tubular bows each having a substantially central bow sleeve supporting portion bounded by respective strut portions adapted to elevate the fabric cover member above respective gunwales of a boat hull, said bows in assembly being pivoted to said gunwales to permit folding and having stays to secure the Bimini top in a deployed position.

4. The boat buoyancy aid according to claim 3, wherein said inflation gas supply comprises an explosive gas supply or a compressed gas supply, and is selectively operable by a trigger.

5. The boat buoyancy aid according to claim 4, wherein the trigger is selected from one or more of mechanical, immersion or hydrostatic triggers.

6. The boat buoyancy aid according to claim 3, wherein the Bimini top comprises a primary bow having a pair of spaced strut portions each extending from a pivot point on each gunwale and an upper portion forming the aft edge of the Bimini top, the strut portions of the primary bow supporting respective ends of pivotally mounted forward and intermediate bow.

7. The boat buoyancy aid according to claim 3, wherein the inflatable buoyancy chambers comprise a pair of spaced chambers each adapted to locate on the fabric cover member at respective port and starboard sides thereof.

8. The boat buoyancy aid according to claim 3, wherein the one or more inflatable buoyancy chambers are located transverse the boat hull adjacent the aft edge of the Bimini top.

9. The boat buoyancy aid according to claim 3, wherein the buoyancy chamber is formed from a material selected from inflatable personal flotation device material, fabric-reinforced vinyl materials, HYPALON®, woven NYLON® or polyester material coated with a polyurethane or polyolefin heat bonding/gas seal layer.

10. The boat buoyancy aid according to claim 9, wherein the material is selected from high tensile or standard woven NYLON®, having a coating selected from flame-retardant or standard thermoplastic polyurethane (TPU).

11. The boat buoyancy aid according to claim 9, wherein the material is selected from silicone coated rip stop NYLON®, HD Polyester and TPU ether film.

12. A boat buoyancy aid including a fabric cover member supported on a Bimini and/or Targa bar structure above respective gunwales of a boat hull, one or more inflatable buoyancy chambers formed in said fabric cover member, an inflation gas supply selectively operable to inflate said buoyancy chambers, and a hydrostatic trigger activated by submergence of the trigger to an activation depth corresponding to an expected depth of submergence on capsize of the boat hull, wherein the inflation gas supply comprises $CO_2$ delivered from a $CO_2$ cartridge.

13. The boat buoyancy aid according to claim 12, wherein the hydrostatic trigger is associated or co-located with the inflation gas supply under the fabric cover member.

14. A boat buoyancy aid including a fabric cover member supported on a Bimini and/or Targa bar structure above respective gunwales of a boat hull, one or more inflatable buoyancy chambers formed in said fabric cover member, and an inflation gas supply selectively operable by trigger means to inflate said buoyancy chambers, wherein the trigger means is mechanical and operated remotely by means of a cable terminated by a remote pull handle or toggle protected from accidental deployment by a cover, wherein said fabric cover is supported by a Bimini top and said cable is laid internally of a bow thereof and led there through to adjacent a gunwale through a lead.

15. A boat buoyancy aid including a fabric cover member supported on a Bimini and/or Targa bar structure above respective gunwales of a boat hull, one or more inflatable buoyancy chambers formed in said fabric cover member, and an inflation gas supply selectively operable to inflate said buoyancy chambers, wherein said each said buoyancy chamber comprises an inflatable bladder enclosed by a fabric closure portion frangibly secured to said fabric cover portion and adapted to retain and protect each said inflatable buoyancy chamber in its deflated state, wherein said fabric closure portion frangibly secured to said fabric cover member comprises a low stretch canvas cover closed by a closure such as a clip-together means or hook-pile fastening, selected to be frangible to release the inflating inflatable buoyancy chamber.

16. The boat buoyancy aid according to claim 15, wherein said inflation gas supply comprises an explosive gas supply or a compressed gas supply, and is selectively operable by a trigger.

17. The boat buoyancy aid according to claim 16, wherein the trigger is selected from one or more of mechanical, immersion or hydrostatic triggers.

18. The boat buoyancy aid according to claim 15, wherein the buoyancy chamber is formed from a material selected from inflatable personal flotation device material, fabric-reinforced vinyl materials, fabric-reinforced chlorosulfonated polyethylene synthetic rubber, a woven nylon polyamide or polyester material coated with a polyurethane or polyolefin heat bonding/gas seal layer.

19. The boat buoyancy aid according to claim 18, wherein the material is selected from high tensile or standard woven nylon polyamide, having a coating selected from flame-retardant or standard thermoplastic polyurethane (TPU).

20. The boat buoyancy aid according to claim 19, wherein the material is selected from silicone coated rip stop nylon material, HD Polyester and TPU ether film.

* * * * *